US008152267B2

(12) United States Patent
Yamaguchi et al.

(10) Patent No.: US 8,152,267 B2
(45) Date of Patent: Apr. 10, 2012

(54) INK JET RECORDING APPARATUS

(75) Inventors: Yukuo Yamaguchi, Tokyo (JP); Yutaka Koizumi, Yokohama (JP); Mikiya Umeyama, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 367 days.

(21) Appl. No.: 12/038,680

(22) Filed: Feb. 27, 2008

(65) Prior Publication Data

US 2008/0211860 A1 Sep. 4, 2008

(30) Foreign Application Priority Data

Mar. 1, 2007 (JP) ..... 2007-051516

(51) Int. Cl.
*B41J 2/165* (2006.01)

(52) U.S. Cl. ..... 347/30; 347/31

(58) Field of Classification Search ..... 347/22, 347/29–31

See application file for complete search history.

(56) References Cited

U.S. PATENT DOCUMENTS 4,600,931 A * 7/1986 Terasawa ..... 347/30
4,819,012 A * 4/1989 Kiyohara et al. ..... 347/30
5,214,447 A * 5/1993 Iwata ..... 347/30
5,311,214 A * 5/1994 Hirasawa et al. ..... 347/6
5,483,266 A * 1/1996 Nakamura ..... 347/23
5,500,659 A * 3/1996 Curran et al. ..... 347/28
5,552,811 A * 9/1996 Kurata et al. ..... 347/28
5,883,648 A * 3/1999 Hetzer ..... 347/33
6,062,670 A * 5/2000 Iwata et al. ..... 347/23
6,062,672 A * 5/2000 Ishize et al. ..... 347/30
6,183,059 B1 * 2/2001 Muhl et al. ..... 347/33
6,257,697 B1 * 7/2001 Kurata ..... 347/33
6,273,546 B1 * 8/2001 Kobayashi et al. ..... 347/29
6,550,890 B2 * 4/2003 Saijo ..... 347/29
6,769,758 B2 * 8/2004 Wanibuchi et al. ..... 347/33
6,918,647 B2 * 7/2005 Silverbrook ..... 347/22
2002/0008728 A1 * 1/2002 Usui et al. ..... 347/29
2002/0024551 A1 * 2/2002 Saito ..... 347/30
2002/0033859 A1 * 3/2002 Mitsuzawa et al. ..... 347/23
2002/0130918 A1 * 9/2002 Hayakawa et al. ..... 347/29
2004/0027409 A1 * 2/2004 Miyauchi ..... 347/30
2004/0095423 A1 * 5/2004 Silverbrook ..... 347/42

* cited by examiner

*Primary Examiner* — Charlie Peng
*Assistant Examiner* — Peter Radkowski
(74) *Attorney, Agent, or Firm* — Canon USA Inc IP Division

(57) ABSTRACT

An ink jet recording apparatus configured to perform recording by discharging ink from a plurality of discharge ports disposed on a recording head. The apparatus includes a cap adapted to cover the plurality of discharge ports disposed on the recording head, a recessed portion defined on a bottom face inside the cap, a suction hole facilitating introducing a negative pressure to the recessed portion, an atmosphere communication hole located outside a range of the recessed portion and communicating with atmosphere, an ink absorber mounted inside the cap to cover the recessed portion, and a suction pump connected to the suction hole and configured to generate a negative pressure. When the plurality of discharge ports is covered with the cap, a projection image obtained when the plurality of discharge ports is projected onto the bottom face exists within the range of the recessed portion.

6 Claims, 11 Drawing Sheets

INK JET RECORDING APPARATUS

BACKGROUND OF THE INVENTION

1. Field of the Invention

The present invention relates to an ink jet recording apparatus including a recording head configured to discharge ink from a plurality of discharge ports disposed on the recording head to perform recording, and a suction mechanism configured to maintain and recover an ink discharge performance of the recording head.

2. Description of the Related Art

Generally, a recording apparatus having a recording function, such as a printer, a copying machine, a facsimile machine, a word processor, a mailing machine, or a quick printing machine, records an image (also including a character, a symbol, and the like) on a recording material with a recording head based on image information. The recording apparatus can be classified into an ink jet type, a thermal transfer type, a laser beam type, a heat sensitive type, and a wire dot-matrix type based on various recording methods. Among these types, an ink jet recording apparatus is configured to discharge ink from a recording head to a recording material based on image information and to record an image on the recording material. As a recording material, a material allowing an image to be formed thereon with ink, such as a paper sheet, a plastic sheet, a photographic printing paper, a sheet for an overhead projector (OHP), a fabric, or the like, is usable.

Further, in the recording apparatus, a scanning method includes a serial type and a line type. The serial type forms an image while alternately repeating a main scan and a sub-scan. The main scan moves a recording head along a recording material. The sub-scan executes a paper delivery of a recording material at a predetermined pitch. The line type forms an image only with a paper delivery (sub-scan) of a recording material while recording one line in a lump using a full multi-head or the like.

An ink jet recording head is configured to discharge an ink droplet from a minute discharge port using an energy generating element. An ink discharge mechanism using the energy generating element includes those of discharging ink using an electromechanical converter, such as a piezoelectric element. Further, the ink discharge mechanism also includes those of discharging ink by a heating action performed when an electromagnetic wave, such as a laser, is irradiated. Furthermore, the ink discharge mechanism also includes those of discharging ink using an electrothermal converter, such as a heating resistance element. A mechanism of discharging ink by generation of heat is configured to generate film boiling of ink utilizing thermal energy and to discharge ink by the pressure of a bubble generated in ink.

In particular, a recording head which discharges ink utilizing generation of heat is advantageous in the following points. Since discharge ports can be arrayed relatively easily and in a high density, the recording head is advantageous to execute recording of high resolution. Further, since a mechanical structure of the recording head can be easily simplified, the recording head can also be easily miniaturized. Furthermore, the advantages of an integrated circuit (IC) technique and a micro-machining technique, which reflect the recent remarkable progress in technology and increase in reliability in a semiconductor field, enable high-density packaging without difficulty and a cost reduction in manufacturing the recording head.

The above-described ink jet recording apparatus discharges ink from a minute discharge port. In a minute discharge port, there may occur the mixture of bubbles and dust into the ink, or ink thickening or the like due to evaporation of an ink solvent. In such a case, ink is no longer suitable for recording, and thus the ink jet recording apparatus may have trouble performing normal image recording. In order to avoid such circumstances, the ink jet recording apparatus performs recovery processing for removing the cause of defective discharge by refreshing ink in a discharge port. As a mechanism to execute this process, the ink jet recording apparatus includes a discharge recovery unit in a position outside a recording area. An exemplary recovery unit configured to execute this recovery processing includes a cap for covering discharge ports arrayed on a discharge surface of the recording head and a suction pump connected to the cap for generating a negative pressure acting on the discharge ports.

Then, a recovery action includes a suction recovery action which applies suction force by a suction pump with the discharge ports covered with a cap to forcibly suction ink from the discharge ports. Further, the recovery action also includes a pressure recovery action which discharges ink from discharge ports while the discharge port surface faces the cap or a separately-provided ink receiver.

On the other hand, in order to prevent a rebound and a leak of ink from a discharge port at the time of a recording action or a suction recovery action, an ink absorber can be located inside the cap. Further, as a solution to when a rebound and a leak of ink occur, the ink jet recording apparatus executes a wiping action, which wipes and cleans a discharge port surface by a flexible wiper, and a preliminary discharge action, which refreshes ink by discharging color-intermingled ink immediately before the start of recording.

However, in a conventional ink jet recording apparatus, the following problem remains to be solved. That is, due to a recent advance in colorization, image quality, resolution, and processing speed of an ink jet recording apparatus, the number of types of ink, the number of discharge ports, or the number of ink colors is on the increase. Further, downsizing of a discharged ink droplet is also in progress. Thus, it is necessary to suitably maintain the property of ink to be discharged from a recording head. Consequently, it is increasingly important to securely remove bubbles or thickened ink remaining in a discharge port.

Further, the ink absorber mounted in a cap is in the form of porous matrix, in which a large pressure loss may occur during discharge and suction of ink. Accordingly, a tendency of an uneven pressure distribution inside the ink absorber causes a problem in which suction recovery in respective discharge ports cannot appropriately be performed. That is, during a suction recovery action, a large suction force is applied to a discharge port in an area adjacent to a suction hole of the cap and a small suction force is applied to a discharge port in an area apart from the suction hole. Such an unbalanced suction force distribution occurs. Therefore, it is difficult to control recovery processing of a recording head.

Further, in recent years, the ink jet recording apparatus has a tendency to miniaturize a discharge port associated with a finer liquid droplet, to increase the number of discharge port arrays associated with an increase in number of ink colors, and to increase the number of discharge ports associated with high resolution and high speed. According to these tendencies, the ink jet recording apparatus is apt to cause such disadvantages that a pressure loss of the whole discharge ports of the recording head is increased and nonuniformity of suction force acting on respective discharge ports is increased. These cause a further reduction in function of suction recovery. That is, as a difference in negative pressure distribution in a cap is made large, a suction balance to the whole discharge ports is made worse. Thus, the ink jet recording apparatus cannot efficiently suction ink from the discharge port. This causes insufficient removal of a bubble or thickened ink in a discharge port, an increase in suction amount and suction time, a decrease in recording quality, and a decrease in performance of the ink jet recording apparatus itself.

With respect to these technical problems, in a conventional technique, several methods are proposed. These methods include a method for suctioning ink with separate caps for each discharge port array of color ink, and a method for suctioning ink from discharge port arrays of respective color inks one after another with a single suction cap. However, these methods cause such disadvantages that an apparatus main body becomes complicated, an apparatus becomes large, a manufacturing cost increases, and recovery processing time becomes long.

SUMMARY OF THE INVENTION

The present invention is directed to an ink jet recording apparatus capable of uniformizing suction force in a plurality of discharge ports to allow an efficient suction recovery action and to quickly eject, from a cap, ink suctioned from the discharge ports.

According to an aspect of the present invention, an ink jet recording apparatus configured to perform recording by discharging ink from a plurality of discharge ports disposed on a recording head includes a cap adapted to cover the plurality of discharge ports disposed on the recording head, a recessed portion defined on a bottom face inside the cap, a suction hole facilitating introducing a negative pressure to the recessed portion, an atmosphere communication hole located outside a range of the recessed portion and communicating with atmosphere, an ink absorber mounted inside the cap to cover the recessed portion, and a suction pump connected to the suction hole and configured to generate a negative pressure. When the plurality of discharge ports is covered with the cap, a projection image obtained when the plurality of discharge ports is projected onto the bottom face exists within the range of the recessed portion.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

First Exemplary Embodiment

Figure 1:
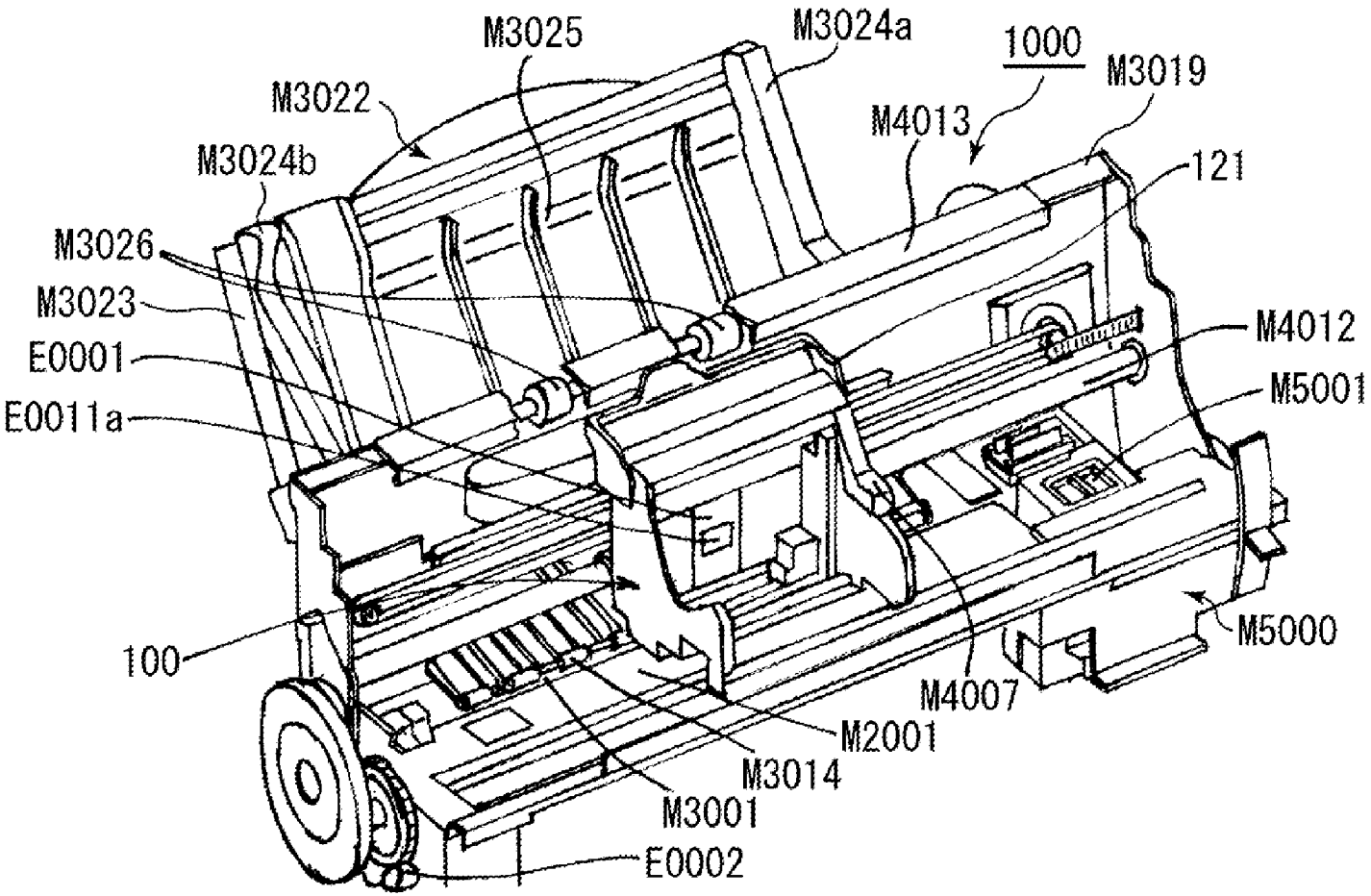
FIG. 1 is a perspective view illustrating an ink jet recording apparatus according to a first exemplary embodiment of the present invention.

FIG. 1 is a perspective view illustrating an ink jet recording apparatus 1000 according to a first exemplary embodiment of the present invention. The ink jet recording apparatus 1000 is configured to discharge ink from a recording head to a recording material based on image information to record an image. The ink jet recording apparatus 1000 includes various mechanisms and various members for a recording action mounted on a chassis M3019 and an exterior member (not illustrated) covering their circumference. The mechanisms for a recording action include an automatic feed unit M3022, a conveying unit (not illustrated), an image forming unit (not illustrated), and a discharge recovery unit M5000. The automatic feed unit M3022 separates a sheet-like recording material, such as a recording sheet or a plastic sheet, one by one to feed the recording material toward the image forming unit inside the ink jet recording apparatus 1000. The conveying unit conveys a fed recording material to an image forming position and leads it from the image forming position to an ejection unit M3030. The image forming unit executes recording on a conveyed recording material. The discharge recovery unit M5000 executes recovery processing to maintain and recover an ink discharge performance of a recording head located on the image forming unit.

The automatic feed unit M3022 feeds stacked recording materials one by one to the image forming unit. The automatic feed unit M3022 includes a feed roller M3026, side guides M3024*a* and M3024*b*, a pressing plate M3025, a base M3023, a separation sheet (not illustrated), and a separation claw (not illustrated). The base M3023 is mounted on the back face of an ink jet recording apparatus main body. On the front face of the base M3023, the pressing plate M3025 is provided in a freely rotating manner for pressing a recording material to the feed roller M3026. The platen M3025 is provided with the side guides M3024*a* and M3024*b*, which guide both side edges of a recording material with protrusion. The side guide M3024*b* is movable in a width direction and can correspond to the size of a recording material.

The ink jet recording apparatus 1000 separates a top recording material on the pressing plate M3025 with the separation action of the separation sheet and the separation claw by rotating the feed roller M3026 coupled to the drive of a PG motor E0002. The ink jet recording apparatus 1000 feeds the fed recording material to the conveying unit. The ink jet recording apparatus 1000 causes the tip end of the recording material to contact a nip portion of a conveying roller M3001 and a pinch roller M3014 being stopped, thereby forming the recording material into a loop. After the leading edge alignment is executed during the loop formation, the ink jet recording apparatus 1000 starts rotation of the conveying roller M3001 and locates the starting position of the recording material.

The conveying unit includes the conveying roller M3001, the pinch roller M3014, and the platen M2001. The pinch roller M3014 is pressed to the conveying roller M3001 with a pinch roller spring (not illustrated). The pinch roller M3014 generates conveying force by executing driven rotation following rotation of the conveying roller M3001. The ink jet recording apparatus 1000 first conveys the recording material to an image formation start position on the platen M2001 with the conveying roller M3001.

Figure 2:
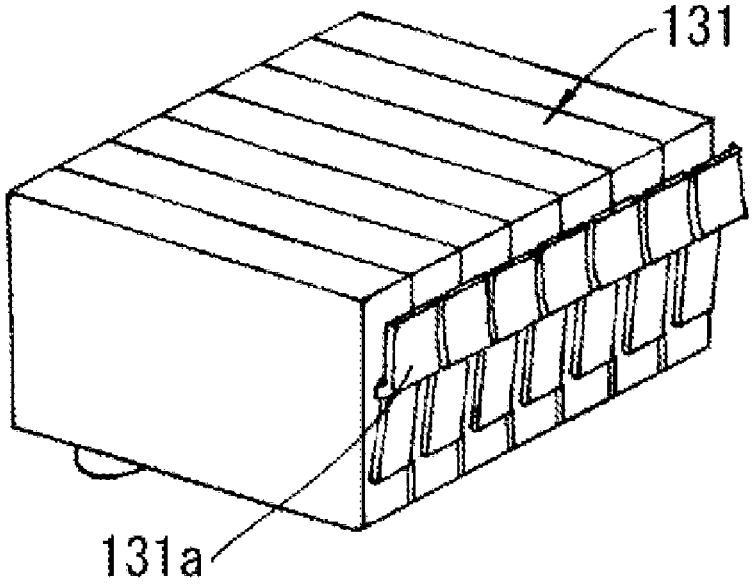
FIG. 2 is a perspective view illustrating a carriage unit according to the first exemplary embodiment of the present invention.
Figure 2:
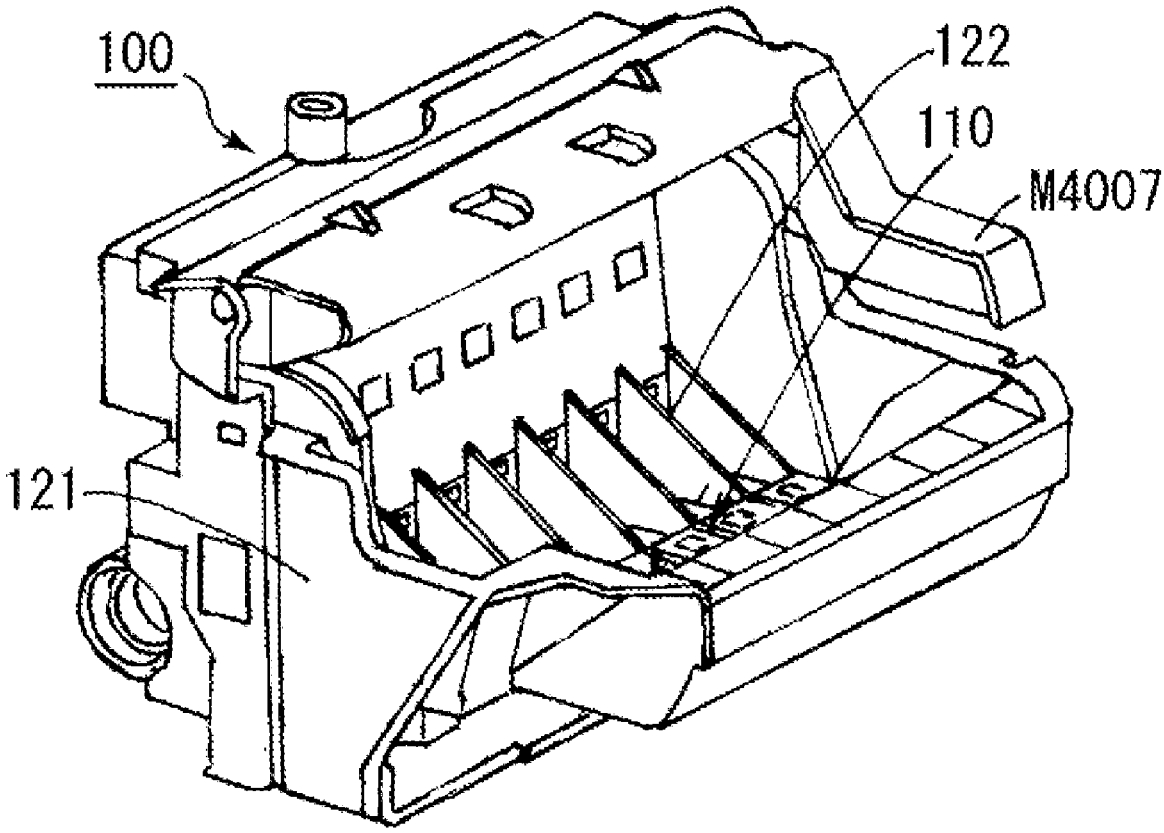

FIG. 2 is a perspective view illustrating a carriage unit 100 of the ink jet recording apparatus 1000 in FIG. 1. The carriage unit 100 includes a recording head 110 mounted on a carriage 121 and an ink tank 131 mountable on the recording head 110 to be freely replaced. The carriage unit 100 is guided and supported by a carriage shaft M4012 and a carriage rail M4013 to be reciprocally movable.

In FIG. 2, the carriage unit 100 includes a tank holder 122 for positioning and holding the ink tank 131 on the recording head 110. The ink tank 131 is mounted on the recording head 110 with a latch lever 131*a* to be detachably attached. The carriage unit 100 fixes the recording head 110 with a head set lever M4007 with the ink tank 131 mounted.

The carriage unit 100 includes an electric substrate E0001 (FIG. 1) having a contact portion E0011*a* on a junction portion to the recording head 110 of the carriage 121. The carriage unit 100 electrically brings the contact portion E0011*a* into contact with an input terminal 4*a* (FIG. 3) of a wiring substrate 4 of the recording head 110, thereby executing transmission and reception of various information for recording, electric power supply to the recording head 110, or the like. Then, the carriage unit 100 alternately repeats recording of one line on a recording material by main scanning of the recording head 110 mounted on the carriage 121 and sheet delivery at a predetermine pitch by the conveying roller M3001, thereby executing recording for the whole recording material.

Figure 3:
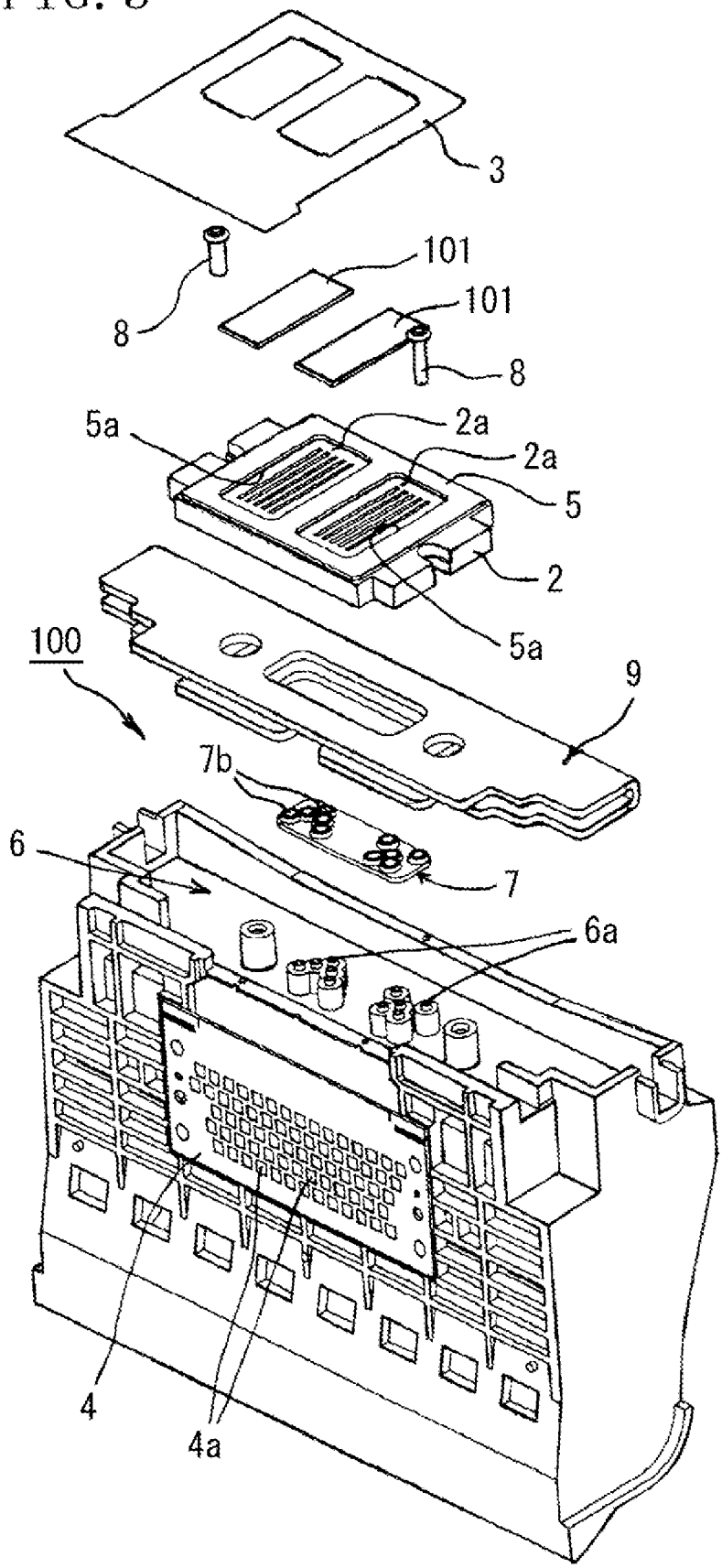
FIG. 3 is an exploded perspective view illustrating a recording head according to the first exemplary embodiment of the present invention.

FIG. 3 is an exploded perspective view illustrating the recording head 110. A recording element substrate 101 includes an ink discharge portion of the recording head 110. In the present exemplary embodiments, the recording head 110 juxtaposes two recording element substrates 101. The recording head 110 includes a supporting member 2, fixed with the recording element substrate 101, and a sheet-like electric wiring substrate 3. A wiring substrate 4 is attached to the back face of the recording head 110. The wiring substrate 4 includes input terminals 4*a*. A plate 5 is fixed to the supporting member 2 in the same height position as that of the recording element substrate 101. The recording head 110 includes a flow path member 6, a seal member 7, and a heat radiation plate 9. The recording head 110 fixes the supporting member 2 and the heat radiation plate 9 to the flow path member 6 with screws 8. Thus, the recording head 110 is assembled.

A plurality of discharge port arrays is formed on the recording element substrate 101. Further, a recording element and wiring are provided on the recording element substrate 101. The recording element is configured to discharge ink from the respective discharge ports. The wiring supplies electric power to the recording element. Further, a recessed ink chamber 1*a* (FIG. 7), which communicates with the respective discharge ports, is formed on the back face of the recording element substrate 101. Two recording element substrates 101 are positioned on and fixedly bonded to the front face of the supporting member 2. Note that the recording element substrate 101 is not limited to a configuration in which two recording element substrates 101 are disposed as illustrated in FIG. 3.

A common liquid chamber 2*a*, which communicates with the respective discharge ports of the recording element substrate 101 via the ink chamber 1*a*, is formed on the front face of the supporting member 2. An ink supply port 2*c* (FIG. 7), which communicates with the common liquid chamber 2*a*, is formed on the back face of the supporting member 2. A plurality of discharge port arrays are formed on each recording element substrate 101. The plurality of discharge port arrays is configured to allow an image to be formed using a plurality of types of ink that are different in color or property. Opening portions 5*a* are formed on the plate 5, which is fixedly attached to the supporting member 2, to avoid an implementation interference with the recording element substrates 101. The electric wiring substrate 3 is bonded to and held on the top face of the plate 5 to be connected to the recording element substrate 101. The electric wiring substrate 3 and the wiring substrate 4 are connected to each other with lead bonding, wire bonding, patterning, or a connector. When an electric signal from the ink jet recording apparatus main body is applied to the recording element substrate 101 via the input terminal 4*a*, the recording head 110 selectively discharges ink from the respective discharge ports. Thus, the recording head 110 performs recording of an image.

Communication paths 7*b* are formed on the seal member 7. The seal member 7 seals and connects the ink supply port 2*c* (FIG. 7) of the supporting member 2 and an ink flow path 6*a* of the flow path member 6, which communicate with each other. The seal member 7 is formed with rubber, elastomer, or the like. Thus, ink supplied from the ink tank 131 mounted on the flow path member 6 is supplied to the common liquid chamber 2*a* (FIG. 7) through the ink supply port 2*c* of the supporting member 2. Then, ink is supplied from the common liquid chamber 2*a* to respective discharge ports. The heat radiation plate 9 is fixed to the back face of the supporting member 2 with an adhesive or the like. Thus, heat generated by supplying electric current to the recording element of the recording element substrate 101 is quickly radiated.

Figure 4:
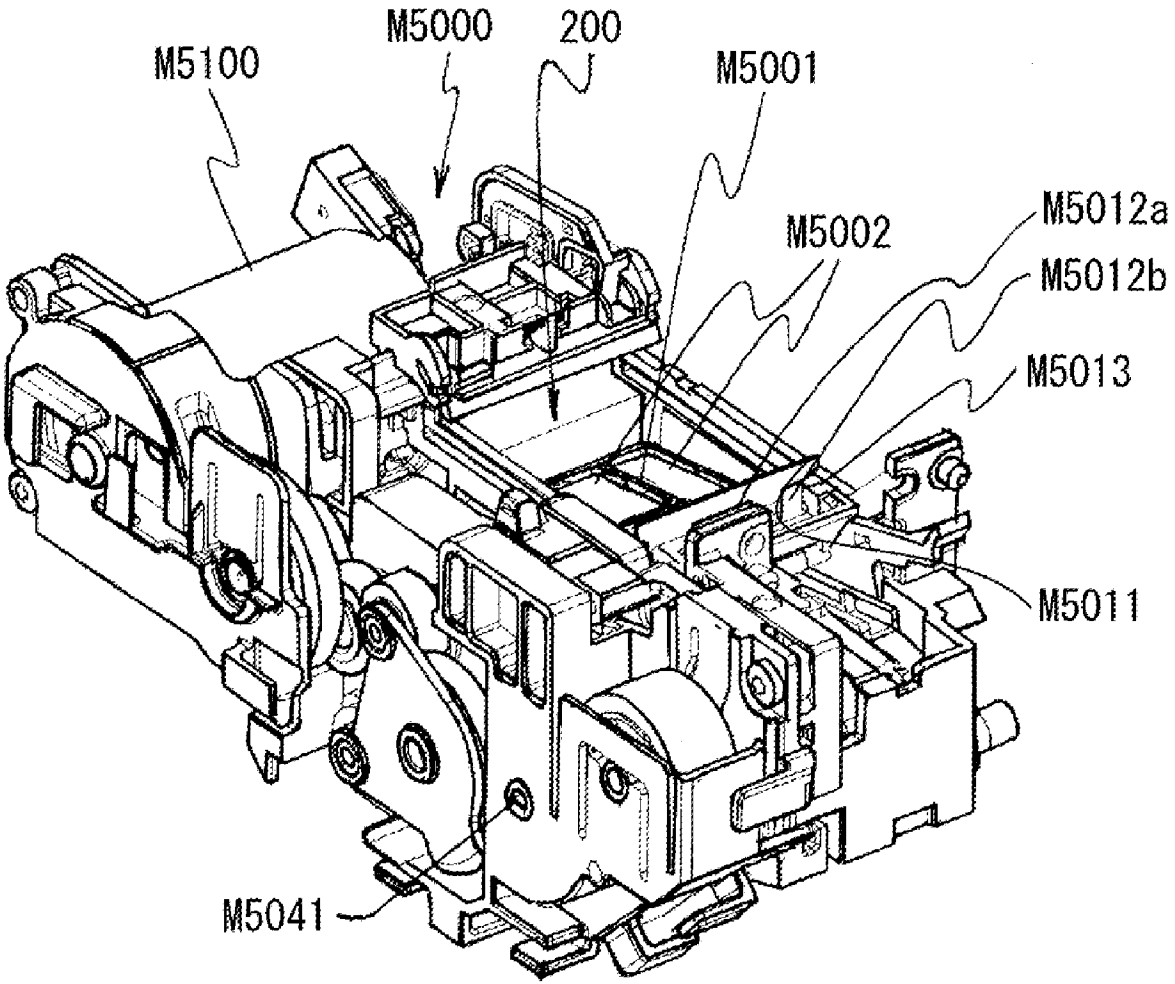
FIG. 4 is a perspective view illustrating a discharge recovery unit according to the first exemplary embodiment of the present invention.
Figure 5:
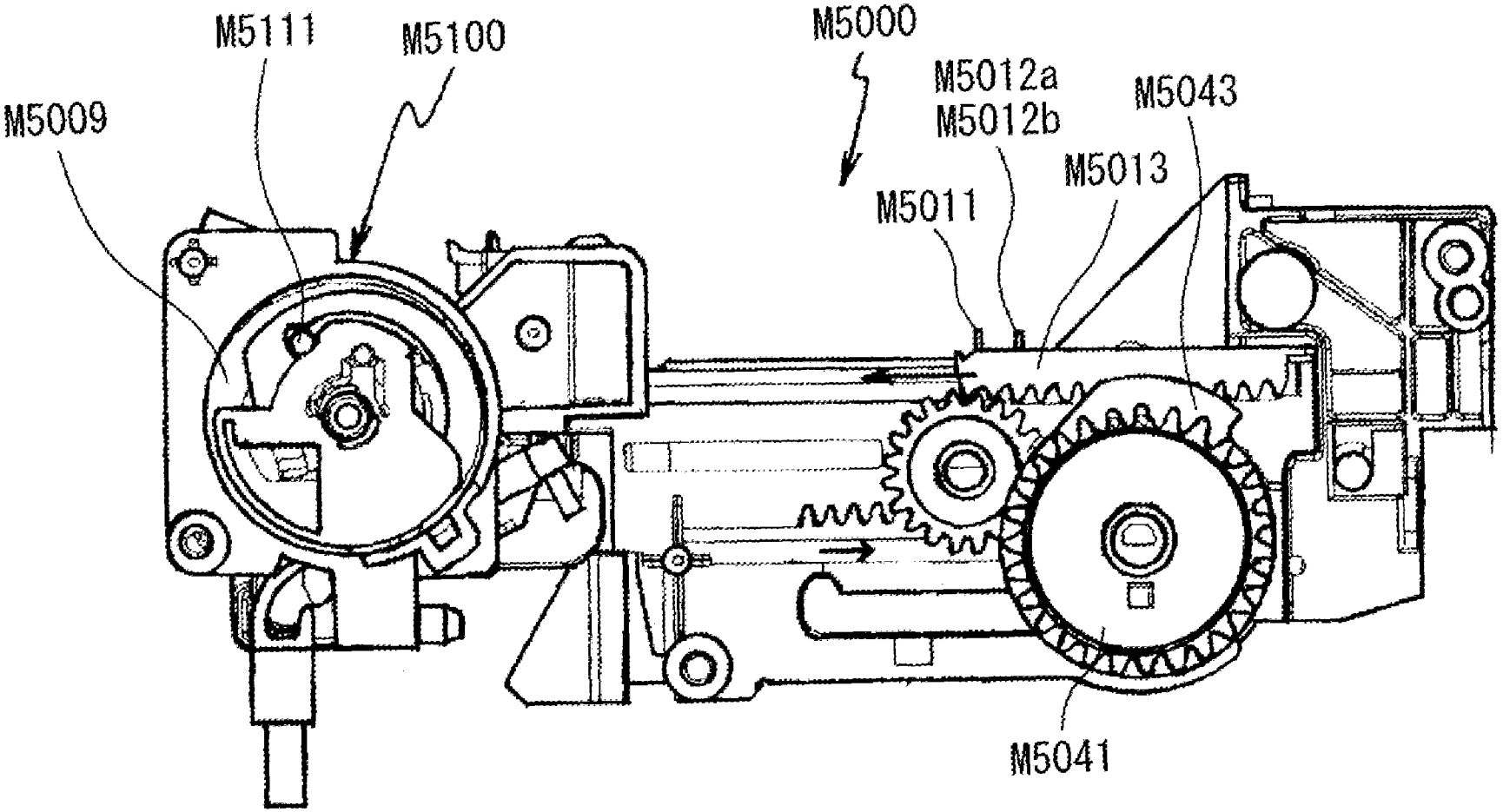
FIG. 5 is a side view illustrating the discharge recovery unit with an outer shell thereof removed in FIG. 4.

FIG. 4 is a perspective view illustrating the discharge recovery unit M5000 according to the first exemplary embodiment. FIG. 5 is a side view illustrating the discharge recovery unit M5000 with an outer shell thereof removed in FIG. 4. The discharge recovery unit M5000 is configured to be detachably attached to the ink jet recording apparatus main body. The discharge recovery unit M5000 includes a wiper for wiping and removing contamination, such as ink adhering to a discharge surface 101*a* (FIG. 7) of the recording element substrate 101. Further, the discharge recovery unit M5000 includes an ink ejection mechanism to refresh ink in a flow path from the ink tank 131 to the recording element substrate 101. Recovery with the ink discharge mechanism is executed by the action of suction and discharge of ink from the discharge ports or the action of preliminary discharge of ink from the discharge ports.

The discharge recovery unit M5000 includes a cap unit 200, a suction pump M5100, and wipers M5011, M5012*a*, and M5012*b*, which are driven by the PG motor E0002, serving as a recovery system driving source. In the present exemplary embodiment, the discharge recovery unit M5000 is configured to drive the cap unit 200 (cap M5001) and a wiper holder M5013 (wipers M5011, M5012*a*, and M5012*b*) by rotation in one direction of the PG motor E0002, and to drive the suction pump M5100 by rotation in the opposite direction thereof.

Figure 6:
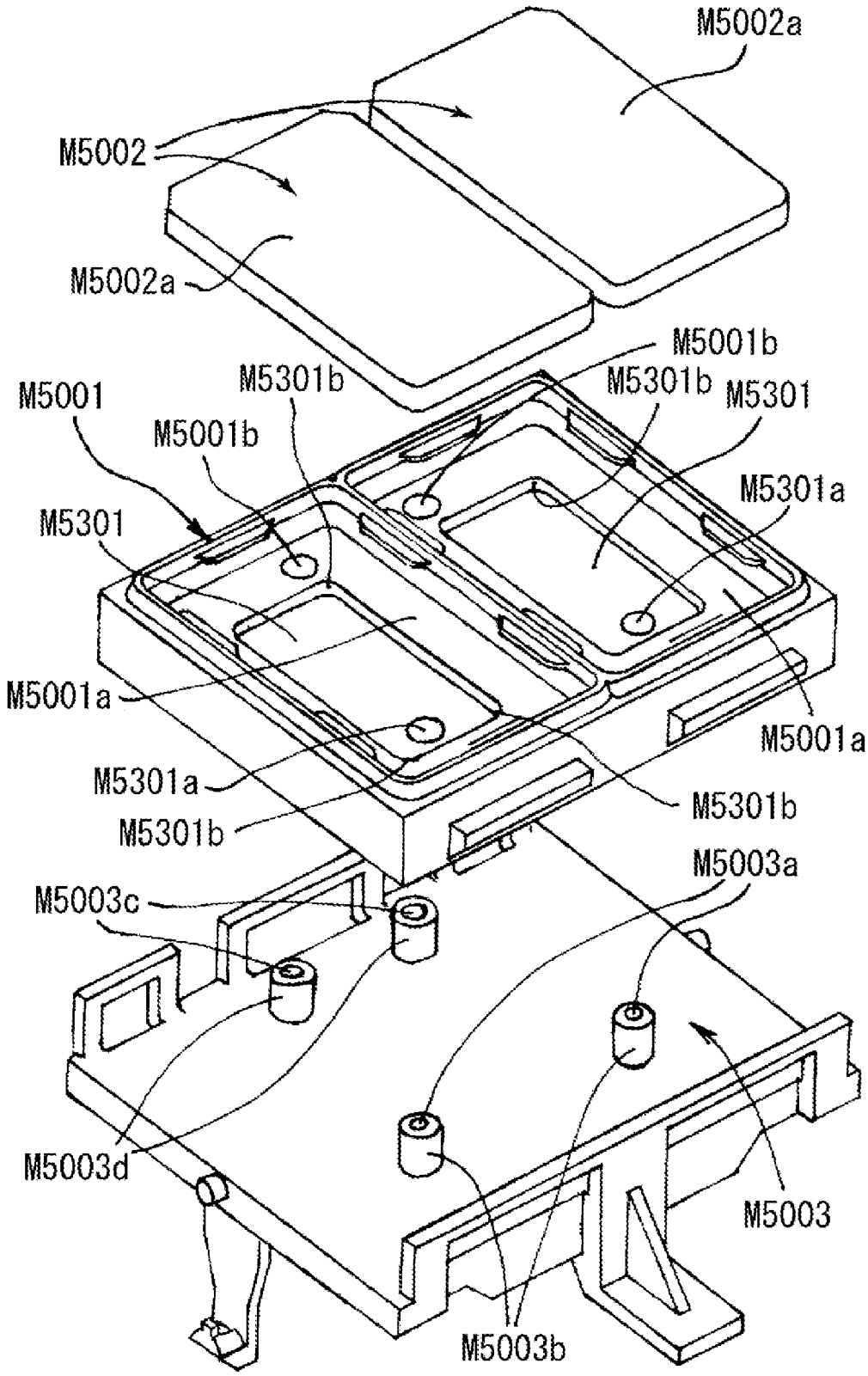
FIG. 6 is an exploded perspective view illustrating a cap unit according to the first exemplary embodiment of the present invention.

In the cap unit 200, the cap M5001, made of a rubber material, is held by a cap holder M5003 (FIG. 6). The cap holder M5003 is attached to a rotatable cap lever (not illustrated). The discharge recovery unit M5000 vertically drives the cap unit 200 via a one-way clutch M5041, a main cam M5043, and the cap lever. Then, the cap M5001 moves upwards to cap the discharge surface 101*a*. An ink absorber M5002, made of a porous material or the like, is mounted on a bottom face M5001*a* inside a seal wall of the cap M5001. The ink absorber M5002 prevents a rebound and overflow of ink discharged from the discharge ports. In the state of capping the discharge ports, the ink absorber M5002 faces the recording element substrate 101 at a predetermined interval (space M5001*c* in FIG. 7).

The wipers M5011, M5012*a*, and M5012*b*, made of a flexible member, such as rubber, is held by the wiper holder M5013. The wiper holder M5013 is reciprocally movable in a direction (recording material conveying direction) intersecting with a carriage moving direction via the one-way clutch M5041 and a gear array (not illustrated). The discharge recovery unit M5000 reciprocally moves the wiper holder M5013 to wipe and clean the discharge surface 101*a* of the recording head 110 with the wipers M5011, M5012*a*, and M5012*b*. When the wipers M5011, M5012*a*, and M5012*b* execute a wiping action, the discharge recovery unit M5000 holds the cap M5001 in a state away from the discharge surface 101*a*. Also, a further movement of the wipers M5011, M5012*a*, and M5012*b* wiping and cleaning the discharge surface 101*a* allows a stain attached to the wipers M5011, M5012*a*, and M5012*b* to be removed by a wiper cleaner (not illustrated).

Figure 7:
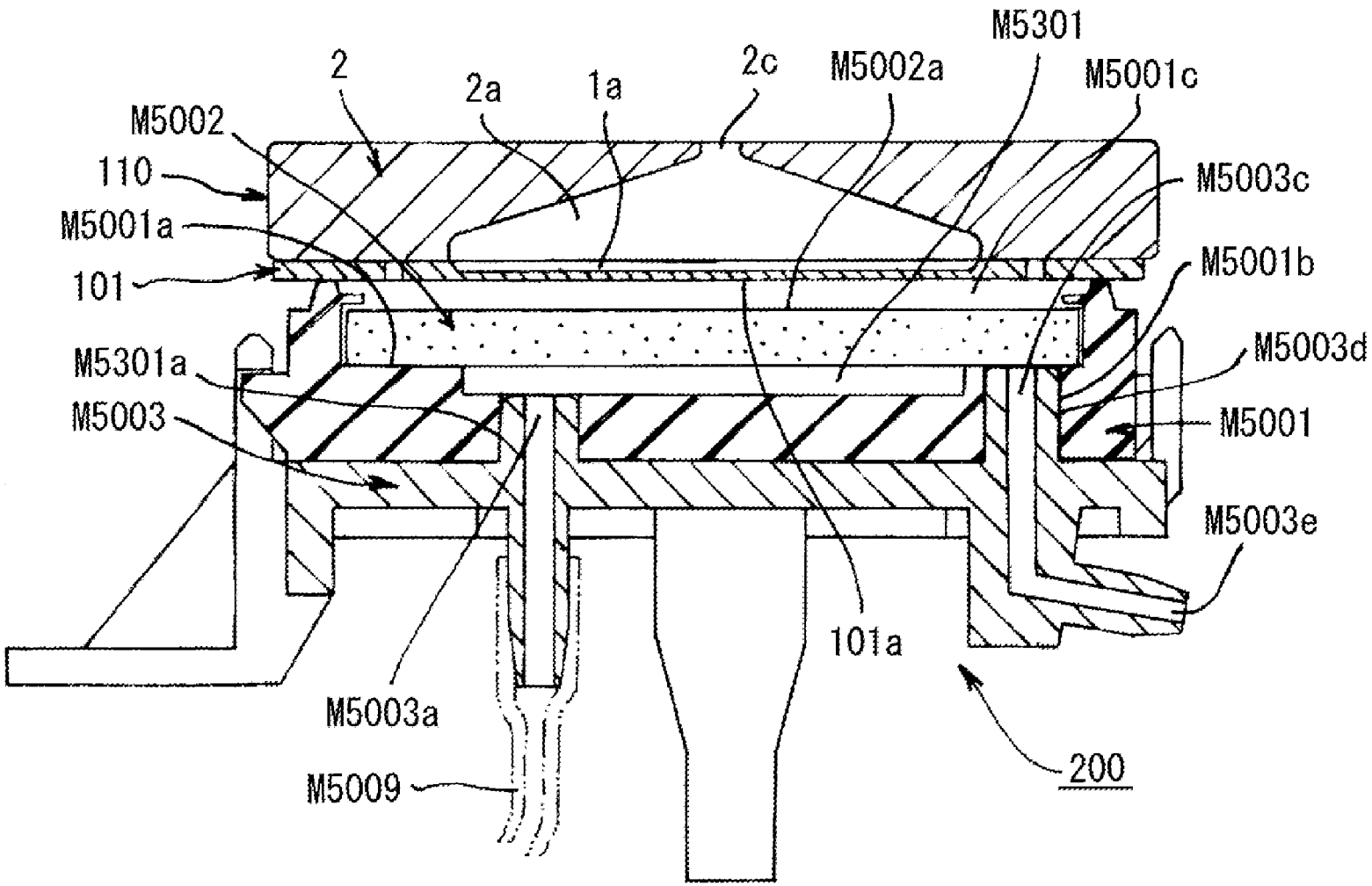
FIG. 7 is a longitudinal cross section illustrating a state of discharge ports of a recording head covered with a cap in an ink jet recording apparatus according to the first exemplary embodiment of the present invention.

A tube M5009 (FIG. 7) is connected to the cap holder M5003. The tube M5009 is connected to the suction pump M5100. The inside of the cap M5001 is connected to the tube M5009 via a suction hole M5003*a* (FIG. 7). The discharge recovery unit M5000 drives the suction pump M5100 to bring the inside of the cap M5001 into a negative-pressure state. Further, the inside of the cap M5001 can communicate with the atmosphere via an atmosphere communication hole M5003*c* (FIG. 7). The suction pump M5100 in the present exemplary embodiment includes a tube pump configured to squeeze the tube M5009 with a pump roller M5111 to generate a negative pressure.

Next, preliminary discharge will be described. When a suction action and a wiping action are executed, a color mixture, in which a plurality of different colors of ink is mixed together, may occur. For example, when the suction action is completed, ink suctioned from the discharge ports may flow backwards into the discharge ports in a state of a negative pressure. This may cause a phenomenon in which different ink migrates into the discharge ports or ink adhering to the discharge surface is thrust into a different discharge port by the wipers M5011, M5012*a*, and M5012*b*. This may cause a color mixture. In order to prevent this color mixture, the preliminary discharge is executed, which discharges ink from the discharge ports just before the start of recording. Preliminarily discharged ink can also be received by the cap M5001. Alternatively, a separately-provided preliminary discharge receiver can also receive ink. When the cap M5001 receives ink, the ink is discharged towards the ink absorber M5002 inside the cap M5001, and the absorbed ink is suctioned by the suction pump M5100.

Figure 8:
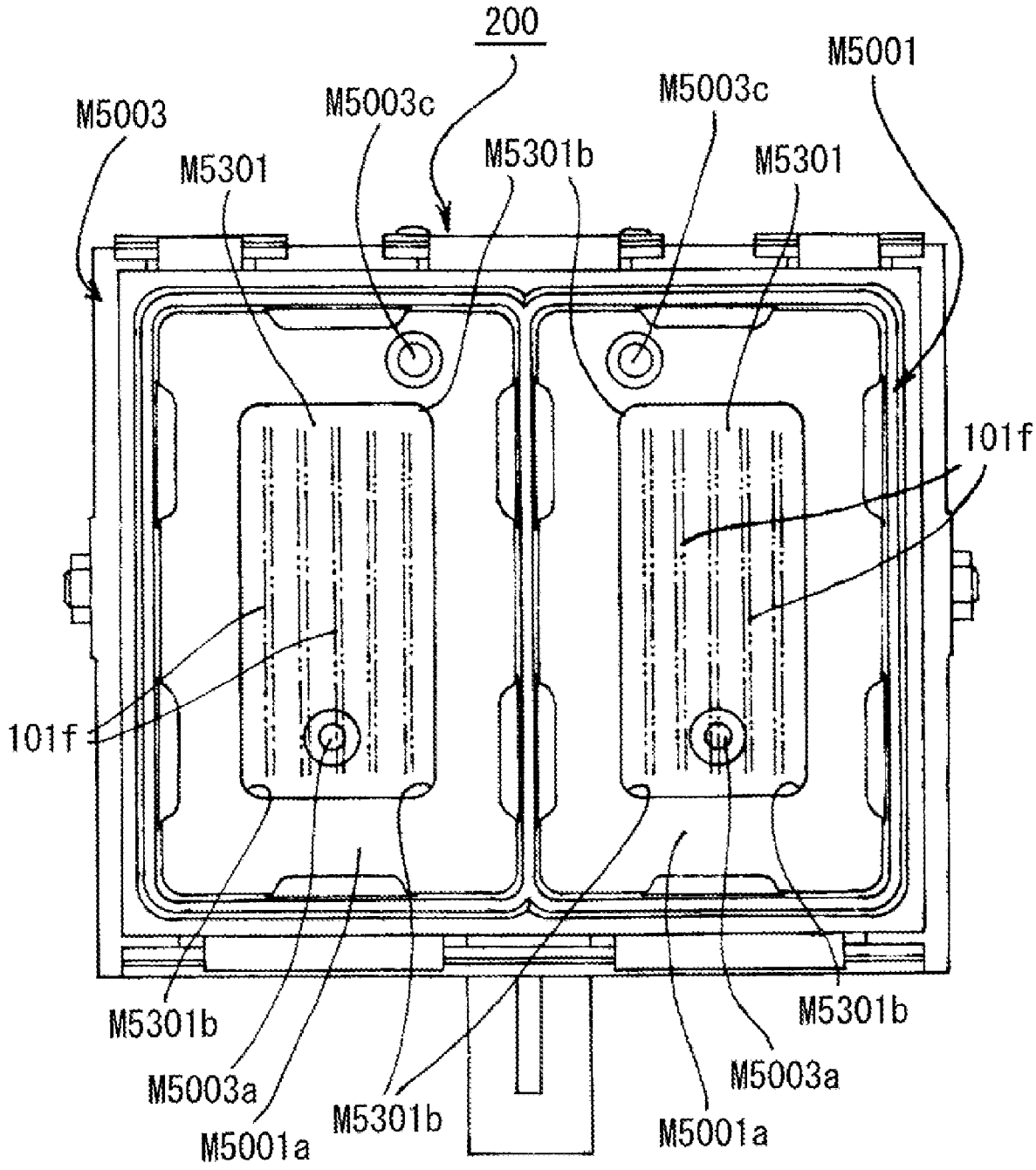
FIG. 8 is a plan view illustrating a state of discharge ports of a recording head projected onto the bottom face inside a cap in an ink jet recording apparatus according to the first exemplary embodiment of the present invention.

Next, the cap unit 200 of the ink jet recording apparatus 1000 according to the present exemplary embodiment will be described in detail. FIG. 6 is an exploded perspective view illustrating the cap unit 200 according to the first exemplary embodiment of the present invention. FIG. 7 is a longitudinal cross section illustrating a state of a discharge port of the recording head 110 covered with the cap M5001 in the ink jet recording apparatus 1000 according to the first exemplary embodiment of the present invention. FIG. 8 is a plan view illustrating a state of a discharge port of the recording head 110 projected onto the bottom face M5001*a* inside the cap M5001 in the ink jet recording apparatus 1000 according to the first exemplary embodiment of the present invention.

The cap unit 200 includes the cap M5001 and the cap holder M5003. The suction hole M5003*a* is formed in the cap holder M5003. The suction hole M5003*a* is connected to the tube M5009. The tube M5009 is connected to the suction pump M5100. The cap unit 200 can suction and eject ink in the cap M5001 via the suction hole M5003*a*. Further, the atmosphere communication hole M5003*c*, which can communicate with the atmosphere, is formed in the cap holder M5003. The atmosphere communication hole M5003*c* is connected to a switchable atmosphere communication valve via a connection port M5003*e*.

A recessed portion M5301 is formed on the bottom face M5001*a* inside the cap M5001. The recessed portion M5301 includes a recessed surface one step lower than the bottom face M5001*a* inside a seal wall of the cap M5001. The recessed portion M5301 corresponds to a part of a suction path in the cap M5001. In the present exemplary embodiment, the cap M5001 includes two cap portions mutually partitioned. The recessed portion M5301 is formed in each cap portion. A first opening M5301*a* is formed in each recessed portion M5301. A second opening M5001*b* is formed on the bottom face M5001*a* in the cap M5001 in a position outside the recessed portion M5301. A first cylindrical portion M5003*b*, in which the suction hole M5003*a* is formed, is formed at two places on the cap holder M5003. Further, a second cylindrical portion M5003*d*, in which the atmosphere communication hole M5003*c* capable of communicating with the atmosphere is formed, is formed at other two places on the cap holder M5003.

Once the cap M5001 is attached to the cap holder M5003, the first cylindrical portion M5003*b* closely fits in the first opening M5301*a*, and also the second cylindrical portion M5003*d* closely fits in the second opening M5301*b*. Thus, the suction hole M5003*a* opens into the recessed portion M5301 in a sealed state. Further, the atmosphere communication hole M5003*c* opens into a position outside the recessed portion M5301 in a sealed state.

The ink absorber M5002 is mounted on the bottom face M5001*a* in the cap M5001 in the state of covering the recessed portion M5301 as a lid. Further, an opening end in the cap M5001 of the atmosphere communication hole M5003*c* is in the state of being covered with the mounted ink absorber M5002.

In FIG. 8, in a capping state where the cap M5001 closely contacts the discharge surface 101*a* of the recording head 110, if a discharge port array of the recording head 110 is projected onto the bottom face M5001*a* of the cap M5001, a projection image 101*f* of the discharge port array exists within the range of the recessed portion M5301. A plurality of twodot chain lines drawn within the range of the recessed portion M5301 indicates the projection image 101*f* from a plurality of discharge port arrays. In the cap unit 200 having the above-described configuration, driving the suction pump M5100 brings a space M5001*c* between the surface M5002*a* of the ink absorber M5002 and the discharge surface 101*a* of the recording head 101 into a negative-pressure state. Thus, the cap unit 200 suctions ink from the discharge ports and ejects it to a waste ink absorber M5002.

Since the inside of the ink absorber M5002 is porous (spongy), a large pressure loss occurs therein during suction. Thus, if a negative pressure is introduced from the suction hole M5003*a* to the recessed portion M5301, the ink absorber M5002, located on the suction downstream side of the recessed portion M5301 (opposite to the suction pump M5100), serves as a large resistance member. This reduces a difference in pressure inside the recessed portion M5301. Further, this reduces a difference in pressure to be applied to the space M5001*c* between the top surface M5002*a* of the ink absorber M5002 and the discharge surface 101*a* of the recording head 110. Accordingly, the cap unit 200 will uniformly apply suction force to the discharge ports of the capped recording head 110. This can reduce the amount of ejected ink in suction recovery and also decrease acting time of the suction recovery. Further, the recessed portion M5301 has a rectangular shape, and its corner area M5301*b* is formed with a curved surface. Therefore, the cap unit 200 does not retain ink contained inside the recessed portion M5301 in the corner area. The cap unit 200 can smoothly eject ink.

According to the above-described exemplary embodiment, even if a recording head includes a plurality of recording element substrates 101 located away from each other, the cap unit 200 can reduce a difference in suction force applied to each discharge port during a suction recovery action. Accordingly, when the cap unit 200 suctions a bubble or thickened ink using one cap, the cap unit 200 can suction and remove a bubble or thickened ink inside each discharge port uniformly and efficiently. The cap unit 200 can remarkably enhance a processing performance in the suction recovery. This can reduce an ink consumption amount and shorten recovery processing time in the suction recovery.

Further, merely providing the suction hole M5003*a* at one place in the recessed portion M5301 allows a desirable discharge recovery processing performance to be secured. This allows a cost reduction of a discharge recovery mechanism or a recording apparatus as compared with a conventional configuration having a plurality of suction holes or branching into a plurality of suction holes. Furthermore, the atmosphere communication hole M5003*c* and the recessed portion M5301 communicate with each other only via the ink absorber M5002, which has large resistance with respect to ink flow. For this reason, the cap unit 200 can prevent or reduce the inflow of ink in the recessed portion M5301 into the atmosphere communication hole M5003*c*. This can prevent thickened ink from remaining in an atmosphere communication path by evaporation of ink or the like. Thus, the cap unit 200 can avoid clogging of the atmosphere communication path.

Note that the present exemplary embodiment illustrates the case where the cap M5001 includes two mutually-partitioned cap portions. The present invention is not limited to this configuration. The present invention is similarly applicable to a cap having another configuration. The present invention is similarly applicable to, for example a cap including one cap portion or a cap having a multiple structure including three or more cap portions. Further, a cap can be configured to have a single cap structure including two connected caps and to suction ink from two recording element substrates 101 with one suction hole. Furthermore, a size and shape of each cap portion in this case can be suitably changed. Still furthermore, the present invention is also similarly applicable in a unit type cap using a plurality of mutually independent caps. In these cases, the present invention can freely select the number of discharge port arrays corresponding to each cap or cap portion. Yet furthermore, in the present exemplary embodiment, a plurality of discharge ports constitutes a plurality of discharge port arrays that discharges ink having a plurality of colors. The present invention is not limited to this configuration. The plurality of discharge ports can be discharge ports that discharge ink having different colors. The plurality of discharge ports can also be discharge ports that discharge ink having the same color. The plurality of discharge ports can be a combination thereof.

Second Exemplary Embodiment

Figure 9:
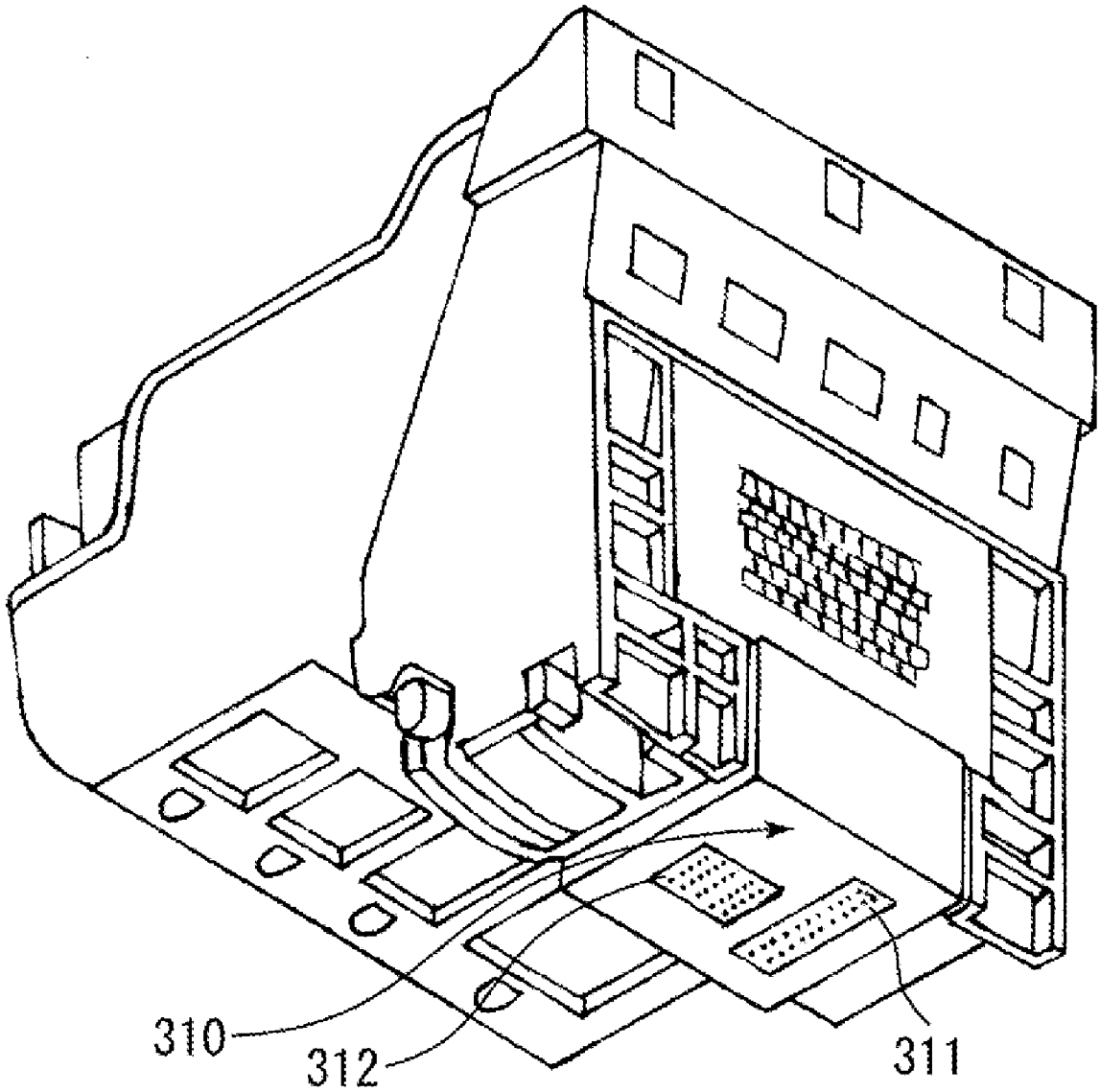
FIG. 9 is a perspective view illustrating a carriage unit according to a second exemplary embodiment of the present invention.
Figure 10:
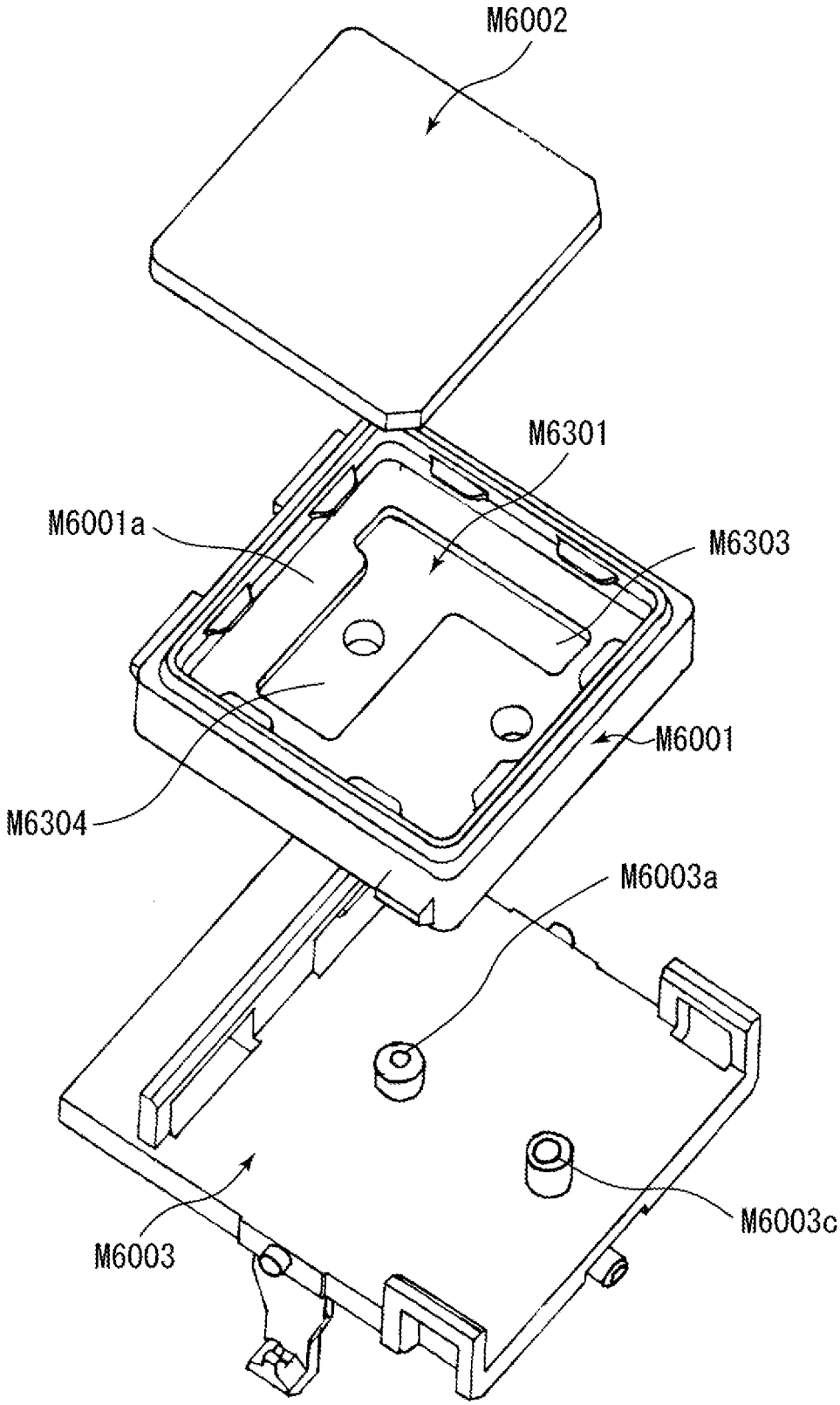
FIG. 10 is an exploded perspective view illustrating a cap unit according to the second exemplary embodiment of the present invention.
Figure 11:
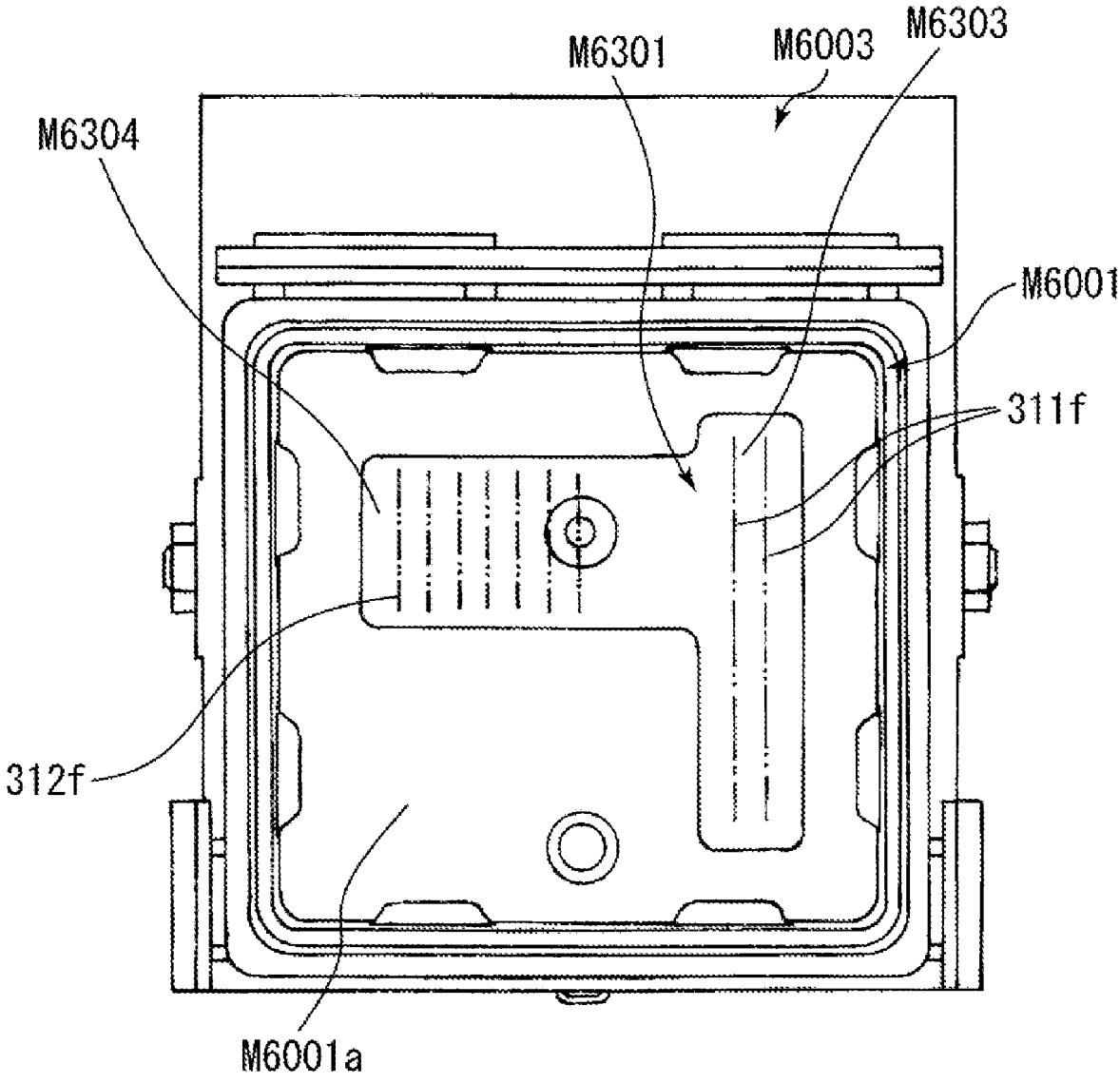
FIG. 11 is a plan view illustrating a state of discharge ports of a recording head projected onto the bottom face inside a cap in an ink jet recording apparatus according to the second exemplary embodiment of the present invention.

FIG. 9 is a perspective view illustrating a carriage unit according to a second exemplary embodiment of the present invention. FIG. 10 is an exploded perspective view illustrating a cap unit according to the second exemplary embodiment. FIG. 11 is a plan view illustrating a state of a discharge port of a recording head projected onto the bottom face inside a cap in an ink jet recording apparatus according to the second exemplary embodiment. In the second exemplary embodiment, a recording head 310 includes a plurality of recording element substrates 311 and 312 having different sizes. The recording head 310 can be capped with one cap M6001, in which one suction hole M6003*a* is located.

In FIGS. 9 to 11, a recessed portion M6301 is formed on a bottom face M6001*a* of the cap M6001. The suction hole M6003*a* is located in the recessed portion M6301. The cap M6001 is held by a cap holder M6003. The recessed portion M6301 includes a vertically long area M6303 and short area M6304, corresponding to the two recording element substrates 311 and 312 having different sizes, which are contiguous as illustrated in FIGS. 10 and 11.

With the cap M6001 mounted on the cap holder M6003, the suction hole M6003*a*, which communicates with the suction pump M5100, is located in the recessed portion M6301. Further, an atmosphere communication hole M6003*c*, which can communicate with the atmosphere, is located in a position outside the recessed portion M6301 on the bottom face M6001*a* of the cap M6001.

In the present exemplary embodiment, an ink absorber M6002 to be mounted on the cap M6001 is mounted on the bottom face M6001*a* with the recessed portion M6301 covered. Then, as illustrated in FIG. 11, when discharge port arrays of the recording head 310 are projected onto the bottom face M6001*a* of the cap M6001 with the recording head 310 capped, projection images 311*f* and 312*f* of the discharge port arrays exist within the range of the recessed portion M6301. In the present exemplary embodiment, the projection image 311*f* of a long discharge port array is located within the range of the long area M6303 and the projection image 312*f* of a short discharge port array is located within the range of the short area M6304.

The second exemplary embodiment can also reduce a difference in suction force to be applied to the discharge ports of the recording head 310, which includes a plurality of recording element substrates 311 and 312 different in a length of array of discharge ports or the number of arrays.

According to an exemplary embodiment of the present invention, an ink jet recording apparatus can be provided, which is capable of uniformizing suction force in a plurality of discharge ports to allow an efficient suction recovery action and to quickly eject, from a cap, ink suctioned from the discharge ports.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2007-051516 filed Mar. 1, 2007, which is hereby incorporated by reference herein in its entirety.

What is claimed is:

1. An ink jet recording apparatus configured to perform recording by discharging ink from a plurality of discharge ports disposed on a recording head, the ink jet recording apparatus comprising:

a cap adapted to cover the plurality of discharge ports, the cap having a bottom face surrounded by a seal wall;

a recessed portion defined on the bottom face inside the cap, the recessed portion having a recessed surface lower than the bottom face;

a suction hole facilitating introducing a negative pressure to the recessed portion;

an atmosphere communication hole located outside a range of the recessed portion and communicating with atmosphere;

an ink absorber mounted on the bottom face of the cap so as to cover the recessed portion entirely, wherein the recessed surface faces the ink absorber and a space is formed between the ink absorber and the recessed surface, and wherein the suction hole is formed on the recessed surface and directly opens into the space; and a suction pump connected to the suction hole and configured to generate a negative pressure, wherein when the plurality of discharge ports are covered with the cap, the bottom face corresponds to all of the plurality of discharge ports, and the space corresponds to all of the plurality of discharge ports.

2. The ink jet recording apparatus according to claim 1, wherein the recording head includes a plurality of discharge port arrays.

3. The ink jet recording apparatus according to claim 2, wherein the plurality of discharge port arrays includes a discharge port array configured to discharge black ink and a discharge port array configured to discharge color ink.

4. The ink jet recording apparatus according to claim 2, wherein the plurality of discharge port arrays is disposed on a plurality of discharge surfaces of the recording head.

5. The ink jet recording apparatus according to claim 1, wherein the recessed portion has a rectangular shape.

6. The ink jet recording apparatus according to claim 5, wherein a corner area of the recessed portion is formed with a curved surface.

* * * * *